US006067022A

United States Patent [19]

Laswick et al.

[11] Patent Number: 6,067,022

[45] Date of Patent: May 23, 2000

[54] LOW INPUT PRESSURE ALARM FOR GAS INPUT

[75] Inventors: Ronald A Laswick, Brampton; Kevin D. J. Bowden, Orangeville, both of Canada

[73] Assignee: O-Two Systems International, Inc., Canada

[21] Appl. No.: 09/066,769

[22] Filed: Apr. 27, 1998

[51] Int. Cl.[7] ..... G08B 21/00

[52] U.S. Cl. ..... 340/626; 340/632; 128/204.18; 128/204.25

[58] Field of Search ..... 340/626, 632; 128/204.18, 204.25, 205.24

[56] References Cited

U.S. PATENT DOCUMENTS

| | | | |
|---|---|---|---|
| 4,064,899 | 12/1977 | Lehmann | 137/269 |
| 4,141,354 | 2/1979 | Ismach | 128/145.6 |
| 4,323,064 | 4/1982 | Hoenig et al. | 128/204.21 |
| 4,350,115 | 9/1982 | Pasternack | 116/70 |
| 5,520,170 | 5/1996 | Laswick et al. | 128/204.18 |
| 5,862,802 | 1/1999 | Bird | 128/204.18 |

FOREIGN PATENT DOCUMENTS

| | | |
|---|---|---|
| 2 691 635 | 12/1993 | France . |
| 854194 | 11/1960 | United Kingdom . |
| WO 99/13945 | 3/1999 | WIPO . |

*Primary Examiner*—Daniel J. Wu
*Attorney, Agent, or Firm*—Parkhurst & Wendell, L.L.P.

[57] ABSTRACT

The invention provides an in-line low supply pressure alarm device powered solely by supply flow of pressurized gas from a gas supply for providing an alarm signal when supply gas pressure is below a selected minimum pressure. The alarm device includes a manifold having an input port for communicating with the supply gas supply, an output port for conducting the gas downstream and a manifold chamber disposed therebetween. Gas powered alarms such as an audible reed alarm or a visual pneumatic alarm are connected to the manifold chamber via an alarm supply conduit, and produce an alarm signal when pressurized gas passes to the alarms. An supply gas pressure sensor, in communication with the manifold chamber, produces an actuating flow of pressurized gas by activating a pressure switch, in response to sensing of an supply gas pressure below the selected minimum pressure. A pneumatic alarm output switch, in the alarm supply conduit and in communication with the pressure sensor and pressure switch via an actuation conduit, controls gas flow to the alarms in response to the actuating flow. Preferably, an alarm oscillation system is included for alternating the direction of the actuating flow to and from the alarm output switch, to open and close the alarm output switch thereby turning the alarm on and off in a cyclical fashion.

5 Claims, 2 Drawing Sheets

LOW INPUT PRESSURE ALARM FOR GAS INPUT

TECHNICAL FIELD

The invention is directed to an in-line pressurized gas powered alarm which can be installed in-line between a regulated gas supply source and any gas utilizing device, such as an oxygen supply transport ventilator/resuscitator for example, to notify the operator visually and audibly when the supply pressure from a regulated gas supply source is below a selected minimum pressure.

BACKGROUND OF THE ART

The invention is particularly of advantage in applications where the depletion of pressurized gas supply is critical and could result in physical danger of suffocation or harmful operation of gas utilizing equipment. The example used in this description is an oxygen gas resuscitator/transport ventilator where an oxygen gas is provided from pressurized gas cylinders or a pipeline through the transport ventilator to a patient face mask. Typically such transport ventilators are used in trauma situations by hospital and ambulance crews, firefighters, military medics, and miners during life threatening emergencies. However, it will be understood that the invention may be applied to any gas utilizing device where warning of low supply pressure is required, and especially where volatile gases are present and electric powered alarms are therefore undesirable.

Basic components of a transport ventilator system include a hand held mask fitted over the patient's nose and mouth, with an automatic resuscitator/ventilator and pressure regulator to control breathable gas flow from a high pressure source of pure oxygen gas.

In the relevant field of cardiopulmonary resuscitation and ventilation, patients during transport and at the scene of an incident are treated with pneumatic or electro-pneumatic ventilators to maintain the patient's respiration.

During this critical period, the operator's attention is primarily focused on the patient and on performing the tasks necessary to maintain the patient's life. Timing of activities is extremely crucial since lack of oxygen can cause permanent damage or death in minutes. The operator has usually taken some time to arrive at the scene and to access the required equipment. In such an environment, ventilation equipment that operates reliably is absolutely essential and automatic operation is highly desirable.

Gas supply pipelines and supply cylinders are normally fitted with pressure regulators, filters and a visual pressure gauge to indicate the pressure of cylinder contents or incoming pipeline pressure. The operator may not be aware of nor have immediate access to the visual pressure gauge.

The ventilator/resuscitator and regulating devices provide a reducing output performance, in terms of pressure and flow delivered to the patient face mask, as the supply diminishes. In the case of pressurized gas cylinders, supply diminishes as the contents are expelled, and where pipelines are used in hospitals for example, gas supply may be interrupted due to supply system malfunction.

Experience in practical life threatening situations has brought into question the prudence of relying on regulator pressure gauges and operator attentiveness, especially in life-threatening situations where operators are highly stressed and busy with other critical matters.

Some prior art regulators are notoriously inaccurate in terms of output performance. For example, regulators generally perform well maintaining constant pressure when gas is passed through the regulator at relatively low flow rates. However at high flow rates, some conventional regulators cannot maintain constant pressure as flow load increases.

A typical regulator usually includes an intake pressure or cylinder contents gauge, however, many regulators do not include an output pressure gauge. Without an output pressure gauge the functioning of the regulator is not monitored. No indication is given of whether gas is actually passing through the regulator, nor whether the regulator is impeding gas flow to such a high degree that malfunction of the regulator is indicated.

Many conventional regulators on the market operate relatively well when gas supply cylinders are at least ¾ full but a reliable indication of contents is not provided when the cylinder contents deplete further. To address the inaccuracy of conventional regulators, manufacturers of ventilators/resuscitators often include a second more accurate regulator, pressure sensors and gauges built into their equipment.

This serious problem with conventional breathable gas supply methods has been recognized by the relevant regulatory agencies. Recent standards and proposed standards for such equipment include a requirement for an audible power failure alarm to indicate loss of electrical or pneumatic driving power.

For example, International Standard ISO 10651-3, 1st ed. Jan. 15, 1997, Lung Ventilators for Medical Use—Part 3: Particular requirements for emergency and transport ventilators, Section 8.2.51.5.1 headed: Power Failure Alarm-Electrical or Pneumatic Driving Power, requires that a ventilator shall have a power failure alarm which activates an auditory signal of at least 7 seconds duration if the electrical or pneumatic power supply falls below the values specified by the manufacturer. Compliance is checked by simulating a drop below the supply power, pneumatic pressure or electrical power, required for the specified purpose of use. (International Organization for Standardization, Case Postal 56, CH-1211 Geneva 20, Switzerland)

Further to the ISO standard, the draft British Standards Institute proposal gives an example where a requirement is imposed for a visual or auditory signal of at least 7 seconds duration on power failure. (ref.: Medical Electrical Equipment-Lung Ventilators-Part 3: Particular Requirements for Emergency and Transport Ventilators (prEN 794-3), provides in Section 51.5.1 Protection Against Hazardous Output-Power Failure Alarm-Electrical or Pneumatic Driving Power, British Standards Institute, 389 Chiswick High Road, London W4 4AL)

Standards imposed in most industrialized countries will likely follow the ISO model, however to date most manufacturers of such equipment do not meet this standard. Therefore, although the risk of power failure has been recognized, there is a delay in implementing the ISO standard for audible alarms, since this standard is not mandatory. No doubt the required redesign of existing equipment to include a power fail alarm, with associated manufacturing and marketing changes will increase the cost of equipment.

Conventional supply pressure monitoring equipment may be electrically powered by batteries. The operator is required to ensure that adequate battery charge is available and unless a fail-safe low battery charge alarm is provided, the gas depletion may go unnoticed due to battery failure. Where volatile gases, such as oxygen gas, are dispensed the presence of electric power there is an inherent risk of explosion.

Automatic ventilator/resuscitators are available that are completely powered by pneumatic pressure provided by the gas supply in order to avoid the disadvantages of reliance on electric power, for example as described in U.S. Pat. No. 5,520,170 by the present inventors. For such equipment, low supply pressure effects not only the delivery of breathable gas to the patient but also the accuracy of control and monitoring circuits in the equipment itself.

It is an object of the invention to produce an in-line low supply pressure alarm device that is set off automatically when the dynamic or static supply pressure is detected below a specified minimum. Preferably, the device does not require electrical power, and is mechanically simple to ensure reliability and low production cost.

In particular it is an object of the invention to provide a low supply pressure alarm device which can be easily retrofitted to existing equipment with a minimum of operator training or equipment downtime during modification. Preferably the device may be adapted as a stand alone add on unit as well as a component included in newly manufactured equipment.

DISCLOSURE OF THE INVENTION

The invention provides an in-line low supply pressure alarm device powered solely by supply flow of pressurised gas from a regulated gas supply to provide an alarm signal when supply gas pressure is below a selected minimum pressure, such as 40.6 psi for example.

The alarm device includes a manifold having an input port for communicating with the supply gas supply, an output port for conducting the gas downstream and a manifold chamber disposed therebetween.

Gas powered alarms such as an audible reed alarm or a visual pneumatic alarm indicator are connected to the manifold chamber via an alarm supply conduit, and produce an alarm signal when pressurised gas passes to the alarms.

A supply gas pressure sensor together with a pressure switch, in communication with the manifold chamber, produces an actuating flow of pressurised gas, in response to sensing of a supply gas pressure below the selected minimum pressure.

A pneumatic alarm output switch, in the alarm supply conduit and in communication with the sensor switch via an actuation conduit, controls gas flow to the alarms in response to the actuating flow.

Preferably, an alarm oscillation system is included for alternating the direction of the actuating flow to and from the alarm output switch, to open and close the alarm output switch thereby turning the alarm on and off in a cyclical fashion.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
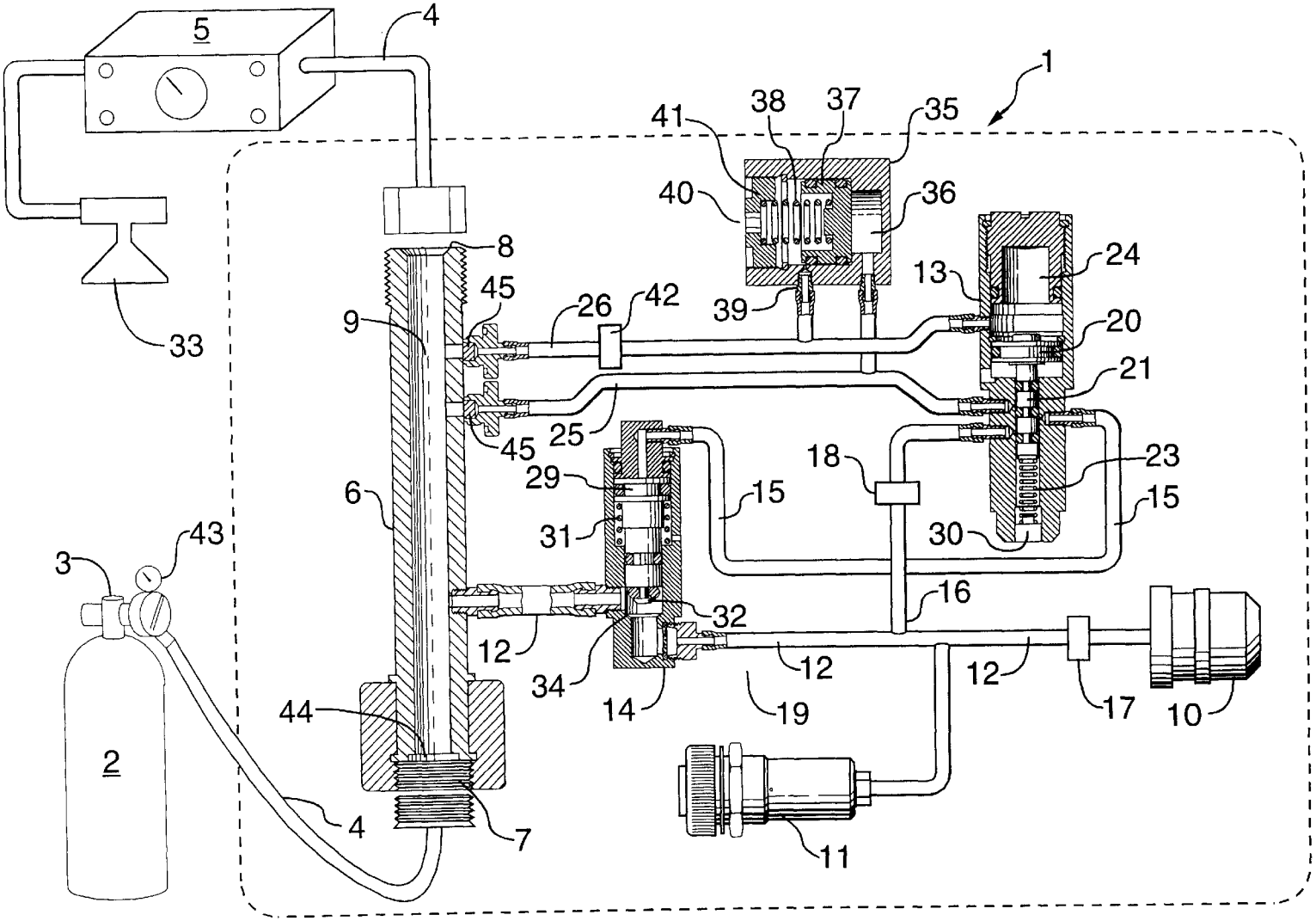
FIG. 1 is a schematic circuit diagram showing the low supply pressure alarm device (encircled in a dashed border) disposed on the supply hose between a compressed oxygen gas cylinder and ventilator/resuscitator with attached face mask, the alarm device including a manifold, both an audible reed and a visual alarm indicator with an alarm output switch, supply pressure sensor, pressure switch and associated circuit conduits, with switches in an "alarm on" position, i.e. when low supply pressure is detected.

FIG. 1 illustrates a typical application of the invention to a common patient ventilator system using compressed oxygen gas. Depletion of oxygen gas supply may lead to risk of suffocation or cessation of assisted breathing.

The low supply pressure alarm device is indicated generally with drawing reference numeral 1 and bounded in dashed outline. The gas supply cylinder 2 contains compressed oxygen gas and is fitted with a pressure regulator 3 in a conventional manner. Commonly the regulator 3 has an attached input pressure or cylinder contents dial gauge 43. An alternative arrangement (not shown) includes supply gas pipelines, as used in hospitals for example, where the regulator 3 and input pressure gauge 43 are connected directly to the pipeline. As mentioned above, a performance monitoring problem with conventional regulators arises if they do not include an output pressure gauge to monitor the operation of the regulator 3 itself.

The supply hose 4 passes compressed oxygen gas from the regulator 3, through the alarm device 1 to the ventilator/resuscitator 5 which supplies breathable gas under pressure to a patient face mask 33. With the notable exception of the low supply pressure alarm 1, the above describes a simple conventional application of breathable compressed oxygen gas.

Turning to the details of the low supply pressure alarm device 1 itself, no external power is required, such as electrical batteries for example, since the alarm device 1 is powered solely by the supply of pressurized gas from the gas supply cylinder 2. Even when the cylinder 2 gas supply is depleted beyond the point where there is sufficient gas for breathing by the patient, there remains an adequate residual gas pressure to operate the low pressure supply alarm and notify the operator that the regulated supply gas pressure is below a selected minimum pressure.

As will be described in detail below, the gas driven audible and visual alarm indicators are preferably of an oscillating type when the depletion of gas pressure in the cylinder 2 is initially below the selected minimum pressure. When gas pressure depletes even further, the alarms gradually cease oscillation and provide a constant continuous alarm. For example, the device 1 may be calibrated to produce an oscillating alarm signal when the supply gas pressure falls below 40.6 psi, and to produce a continuous alarm signal below 28 psi.

The alarm device 1 includes a manifold 6 with an input port 7 which communicates with the regulated gas supply from the cylinder 2, via the regulator 3 and supply hose 4. An output port 8 conducts gas downstream to the ventilator/resuscitator 5 via the supply hose 4. Between the input and output ports 7 and 8, a hollow manifold chamber 9 is disposed. By providing suitable female/male threads on the input and output ports 7, 8, the low supply pressure alarm 1 can be adapted for any conventional supply hose 4, connected directly to conventional regulators 3 or ventilators 5. For example, standard 9/16 inch DISS male and female connectors may be used as indicated in FIG. 1. Replaceable filter 44 in the input port 7 and filters 45 and 19 capture microscopic particles and inhibit contamination of downstream components.

Installation of the alarm device 1 on conventional equipment as a stand alone unit involves minimal down time and is extremely simple requiring minimal operator training. An alarm device 1 can also be included as a standard component of newly manufactured regulators 3 or ventilators 5 to enhance their operation.

The manifold 6, sensor, switches and conduits in the embodiment illustrated are represented in schematic form for clarity. A compact commercial unit has been designed wherein all components are packaged together in a single rectangular plastic housing secured on the supply hose 4.

Any type of gas powered alarm may be provided, however, in the embodiment illustrated in FIG. 1, a vibrating reed alarm 10 and a visual alarm indicator 11 are shown as examples. The visual alarm indicator 11 is of a conventional type used in pneumatic circuits including a spring loaded pneumatically actuated piston head that reciprocates within a chamber and exposes a coloured end of the piston head to a view port. Such visual alarm indicators 11 are conventionally used in noisy applications where an audible alarm 10 is deemed insufficient, and may be mounted to control panels.

The reed alarm 10 and visual alarm indicator 11 are connected to the manifold chamber 9 via the alarm supply conduit 12. The gas powered alarms 10 and 11 produce an alarm signal when pressurized gas passes to them through the alarm supply conduit 12.

The supply gas pressure sensor 35 communicates with the manifold chamber 9 and responds to sensing of a supply gas pressure below the selected minimum pressure. The supply gas pressure sensor 35 in turn operates the pressure switch 13. The pressure switch 13 controls the flow of pressurized gas through the actuation conduit 15 to selectively open and close the pneumatic alarm output switch 14.

Figure 2:
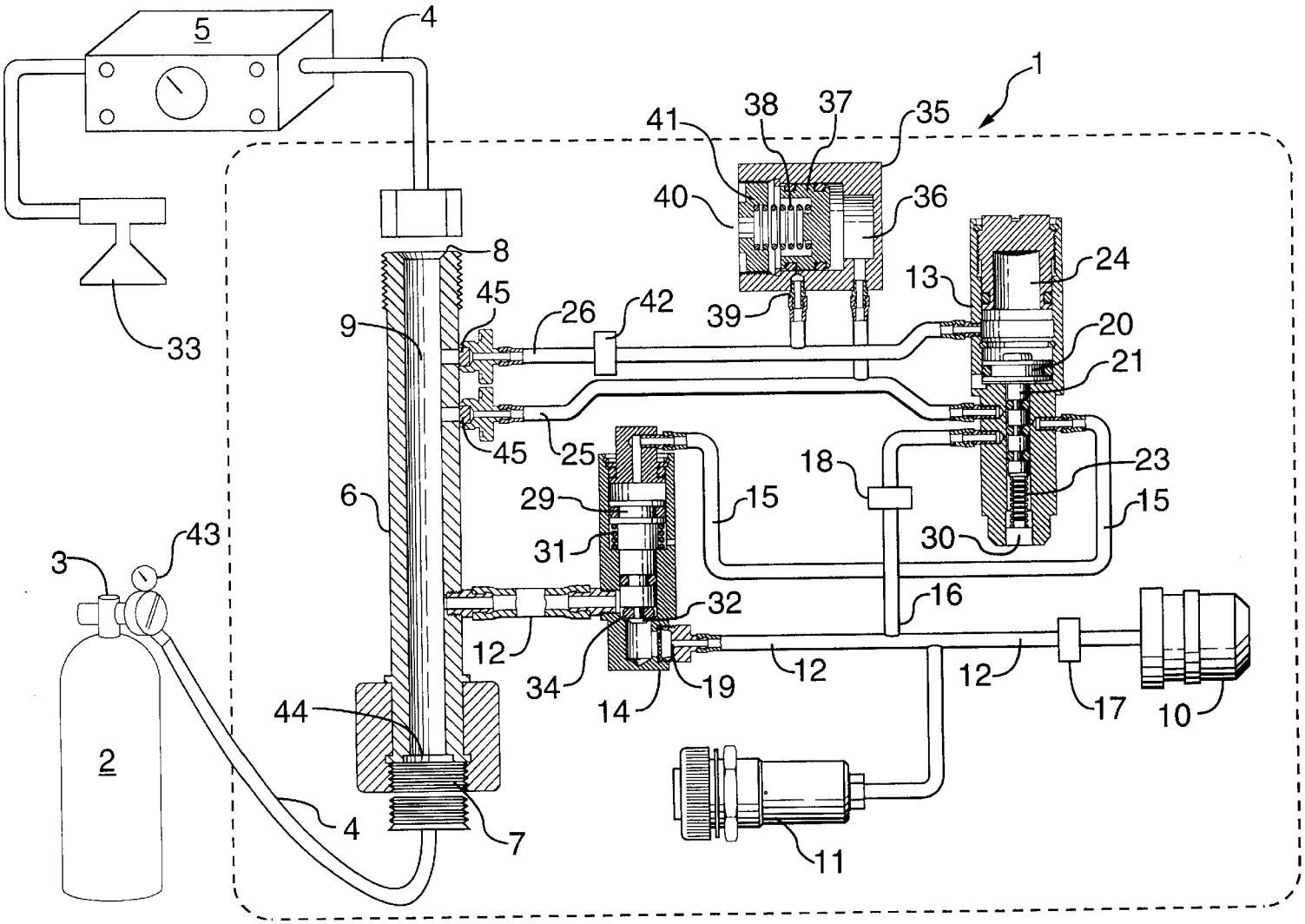
FIG. 2 is a like view with switches in an "alarm off" position, i.e. when sufficient supply pressure is detected.

Referring to FIG. 2, when the control gas supply conduit 25 conducts gas from the manifold 6 at a pressure above the minimum selected value, chamber 36 is pressurized to shift piston 37 to the left (as drawn) against the bias force of spring 38. In this closed position, vent port 39 is closed since gas cannot vent through the ambient vent 40 past the O-ring seals of the piston 37.

With pressure sensor 35 in a closed position as shown in FIG. 2, gas passes from the manifold chamber 9 through the supply gas pressure conduit 26 and flow restrictor 42 to pressurize the chamber 24 of pressure switch 13. Pressure switch 13 is a two-way switch including an actuating piston head 20 and piston stem 21.

In the pressure switch 13, piston head 20 and piston stem 21 are moveable between an "alarm on" (as illustrated in FIG. 1) and an "alarm off" (as illustrated in FIG. 2) position depending on the gas pressure in chamber 24. The pressure switch 13 toggles between two circuit connections, namely: connecting conduit 15 to vent conduit 16 (in FIG. 1); and connecting conduit 15 to conduit 25 (in FIG. 2).

Referring to FIG. 1, when the control gas supply conduit 25 supplies gas at a pressure below the minimum selected value, piston 37 is shifted right under the bias force of spring 38. Threaded cap 41 on the pressure sensor 35 is provided for varying the spring 38 force and accurate pressure sensing calibration.

In the open position shown in FIG. 1, gas flows from the vent port 39 to the ambient vent 40. The flow restrictor 42 impedes gas flow from the manifold chamber 9. A relatively free flow of gas through open vent port 39 vents gas from the pressure switch chamber 24. Rapid upward movement of the piston 20 of switch 13 occurs due to rapid venting of gas in chamber 24 through the ambient vent 40 under the force of spring 23.

In the "alarm on" position shown in FIG. 1, the actuation conduit 15 communicates (via ports in the switch walls and past the reduced diameter portion of the stem 21) with the vent conduit 16, to vent gas pressure and open alarm output switch 14. In the alarm on position, the spring 23 biases the piston head 20 upward as drawn in FIG. 1.

In the "alarm off" position shown in FIG. 2, the actuation conduit 15 communicates with the control gas supply conduit 25. In the alarm off position pressurized gas passes from the manifold chamber 9 through the control gas supply conduit 25 past the piston stem 21 and into the actuating conduit 15 to close the pneumatic alarm output switch 14.

The pneumatic alarm output switch 14 is positioned in the alarm supply conduit 12 and reciprocates between an open and closed position (illustrated in FIG. 1 and 2 respectively). Depending on the pressure of gas conveyed through the actuation conduit 15 into the alarm output switch chamber 27, the alarm output switch 14 will toggle between a fully open position (FIG. 1) and a fully closed position (FIG. 2).

A spring 31 within the alarm output switch 14 biases the piston head 29 to the open position (FIG. 1) wherein the seal ring 32 is raised from the valve seat 34. The actuation conduit 15 communicates with the pressure switch 13 and provides for pressurization and venting of the alarm output switch chamber 27 to respectively close and open the alarm output switch 14. As a result, the alarm output switch 14 controls gas flow to the alarms 10 and 11 in response to the actuating flow conducted through the actuating conduit 15 by the supply gas pressure switch 13.

The configuration illustrated in FIG. 1 shows an alarm device 1 which provides an oscillating alarm. This type of oscillating alarm is considered preferable to a monotone alarm since it generally attracts the attention of the operator more efficiently than a monotone alarm. However, if a monotone alarm is required, the vent conduit 16 can be configured to merely vent to atmosphere rather than as shown to vent into the alarm supply conduit 12.

The alarm device 1 shown, includes means to oscillate the alarm by configuring the vent conduit 16 and attachments described below. Alarm oscillation alternates the direction of actuating gas flow to and from the alarm output switch 14 via the actuating conduit 15. Such oscillation of actuating flow in the actuating conduit 15 is caused by alternating buildup of back pressure in the vent conduit 16 and the decay of such back pressure in the vent conduit 16 as described below.

The means for producing an alarm oscillation include configuring the vent conduit 16 to communicate between the actuation conduit 15 and a downstream portion of the alarm supply conduit 12 between the alarm output switch 14 and the alarm intensity flow resistor 17.

When the alarm output switch 14 is opened, gas passes from the manifold chamber 9 through the alarm supply conduit 12 to the reed alarm 10 and visual alarm indicator 11. The resistance to flow through the alarm intensity flow restrictor 17, prior to venting to atmosphere through the reed alarm 10, creates a gradual building of back pressure in the vent conduit 16. When back pressure in vent conduit 16 builds sufficiently, the direction of gas flow in the vent conduit 16 is reversed. Gas then passes back through the pressure switch 13 into actuation conduit 15. The gradually built up back pressure pressurizes the alarm output switch chamber 27 to close the alarm output switch 14 and terminate flow through the reed alarm 10 and visual alarm indicator 11.

When the alarm output switch 14 closes, no further gas passes from the manifold chamber 9 to the downstream portion of the alarm supply conduit 12. Pressure within the downstream portion of the alarm supply conduit 12, vent conduit 16 and actuation conduit 15 decays by venting through the alarm intensity flow resistor 17 and reed alarm 10. As a result, the pressure within the alarm output switch chamber 27 again decays or drops to the point where pneumatic alarm output switch 14 opens again (due to spring 31 biasing force on the piston head 29) thereby actuating the alarms 10 and 11 to produce an oscillating alarm. Note that the position of the piston 20 and stem 21 of the pressure switch 13 does not change during oscillation of the alarm signal.

To further refine the alarm operation, the alarm oscillation system includes an alarm intensity flow restrictor 17 in the downstream portion of the alarm supply conduit 12 between the audible reed alarm 10 and the vent conduit 16.

The alarm intensity flow restrictor 17 restricts gas flow through the alarm supply conduit 12 and allows adjustment of audible alarm volume. Reed alarms 10 are flow dependent producing sound only when through gas flow rate is within a given range. An excessively high rate of gas flow will not permit the reed to vibrate sufficiently and no audible sound is produced, whereas an excessively low flow rate will produce no sound as well.

Preferably the alarm oscillation circuit also includes an alarm oscillation frequency flow restrictor 18 in the vent conduit 16. This flow restrictor 18 controls the passage of gas downstream during venting of alarm output switch chamber 27 and upstream during back pressure repressurization of alarm output switch chamber 27. As a result, the flow restrictor 18 allows adjustment of the alarm oscillation frequency.

In operation, the low supply pressure alarm device 1 functions as summarized below. Pressurized gas from the cylinder 2 passes through the regulator 3 and supply hose 4 to pressurize the manifold chamber 9. The bulk of the gas flow passes further downstream through the supply hose 4 to the ventilator/resuscitator 5.

However, a portion of the gas supply flow is bled off and pressurizes the supply gas pressure conduit 26, the control gas supply conduit 25 and the alarm supply conduit 12. If the supply pressure is above the selected minimum pressure, the pressurized gas passing through the control gas supply conduit 25 will pressurize chamber 36 of pressure sensor 35 and result in closing the vent port 39.

With vent port 39 closed, as shown in FIG. 2, pressure in supply gas pressure conduit 26 will force the piston head 20 and stem 21 of pressure switch 13 to an alarm off position (FIG. 2) downwardly against the upwardly biasing force of the spring 23. In the alarm off position, pressurized gas also passes through the control gas supply conduit 25 past the pressure switch piston stem 21 into the actuation conduit 15. An actuating flow of pressurized gas thereby passes from the manifold chamber 9 to the alarm output switch chamber 27 forcing the alarm output switch piston head 29 downwardly to a closed position, as shown in FIG. 2, against the bias of spring 31. In the closed position, the seal ring 32 engages the valve seat 34 of the alarm output switch 14 and prevents pressurized gas from flowing through the alarm supply conduit 12 to the reed alarm 10 and visual alarm indicator 11.

In the event that the supply pressure conveyed through the control gas pressure conduit 25 is below the selected minimum pressure, chamber 36 of pressure sensor 35 will depressurize, piston 37 will shift right under the force of spring 38 and result in opening of the vent port 39. Gas pressure in supply gas pressure conduit 26 will drop immediately as gas vents through vent port 39 and ambient vent 40. Flow restrictor 42 prevents gas pressure from recovering by impeding flow from the manifold chamber 9, and any gas passing through the flow restrictor 42 vents through vent port 39 as well.

With very low gas pressure in the conduit 26 and pressure switch chamber 24, the spring 23 in pressure switch 13 forces the piston head 20 and piston stem 21 into an alarm on position, shown in FIG. 1 with the piston head 20 and piston stem 21 upwardly disposed. In the alarm on position, the alarm output switch 14 is opened as the pressure within alarm output switch chamber 27 is vented in an actuating flow through the actuating conduit 15, past the pressure switch stem 21 through vent conduit 16.

When pressure is vented from the alarm output switch chamber 27, the alarm output switch 14 opens and permits pressurized gas to pass from the manifold chamber 9 through the alarm supply conduit 12 to the reed alarm 10 and visual alarm indicator 11.

Simple opening and closing of the alarm output switch 14 will produce alarm signal or shut off the alarm signal as required. To produce an oscillating on/off alarm, an oscillating alarm signal is produced by connecting the vent conduit 16 to a downstream portion between the alarm output switch 14 and flow resistor 17.

To produce an oscillating alarm, the following sequence of operations is followed. The alarm output switch 14 is opened when a low volume of pressurized gas is vented from the alarm output switch chamber 27 via the actuation conduit 15 to the vent conduit 16. A relatively large volume gas flow then passes via alarm supply conduit 12 to the visual alarm indicator 11 and through the flow restrictor 17 to the reed alarm 10.

However, the passage of gas along the alarm supply conduit 12 to the reed alarm 10 encounters resistance from the alarm intensity flow restrictor 17. Back pressure builds up in the alarm supply conduit 12 and reverses flow in the vent conduit 16. Flow reversal caused by back pressure repressurizes the alarm output switch chamber 27 and closes the alarm output switch 14 by depressing the alarm output switch piston head 29.

The reversing back flow of pressurized gas in the vent conduit 16 can be adjusted by setting the alarm oscillation frequency flow restrictor 18. There is a delay between opening and closing of the pneumatic alarm output switch 14. This delay is characteristic of pneumatic toggle switches which are fully open if gas pressure in the chamber 29 is below a selected threshold, and fully closed if gas pressure in the chamber 29 exceeds the threshold. The backpressure will take some time to rebuild after venting and hence the delay that results in oscillation. The delayed alternation between opening and closing of the alarm output switch 14 and simultaneous venting and building up of back pressure in the alarm output switch chamber 27 produces an oscillating audible alarm through the reed alarm 10 and an oscillating visual alarm indicator through the visual alarm indicator 11.

As described above, the invention provides a low supply pressure alarm 1 which requires no outside power, but is driven completely independently by pressurized gas from the regulated gas supply cylinder 2. The frequency of oscillation of the alarm signal will decrease with the depletion of the gas supply and if allowed to continue will produce a continuous monotone alarm signal. It is expected that operators will react quickly to the oscillating alarms produced as soon as the supply gas pressure falls below the selected minimum pressure.

The oscillation and intensity of the alarm can be adjusted or calibrated utilizing the flow restrictors 17 and 18. For example, in a noisy environment, a high volume rapidly oscillating signal may be desired, whereas in a hospital operating room a less startling alarm signal may be desired. In both cases the flow restrictors 17 and 18 can be adjusted easily to provide the desired result. The pressurized gas in alarm supply conduit 12 may also be used to actuate mechanical devices or solenoids for example, in conjunction with equipment to shut down operation if desired.

A significant advantage of the invention is the ability to insert the alarm device in line in existing equipment. The ease of installation and simplicity of retrofitting with existing equipment ensures commercial viability. Since such a simple alarm may be produced relatively cheaply, the continued reliance on conventional regulators alone is not prudent. This is true particularly in view of the recent enactment of requirements by various regulatory bodies.

A particular advantage of the invention is that by positioning it in line, there is no way to easily disable the alarm or manually override its operation, short of complete removal.

In summary therefore, the invention ensures a safe and adequate supply of pressurized gas with a low pressure alarm which can be retrofitted to existing regulators or standard equipment. Reliance on the operator's diligence is reduced. The alarm cannot be disabled except by removal. Placement in line in a supply hose is extremely simple involving minimal down time in existing equipment.

Although the above description and accompanying drawings relate to a specific preferred embodiment as presently contemplated by the inventors, it will be understood that the invention in its broad aspect includes mechanical and functional equivalents of the elements described and illustrated.

The embodiments of the invention in which an exclusive property or privilege is claimed are defined as follows:

1. An in-line low supply pressure alarm device, powered solely by supply flow of pressurised gas from a regulated gas supply, for providing an alarm signal when supply gas pressure is below a selected minimum pressure, the device comprising:

a manifold having: input port means for communicating with the supply gas supply; output port means for conducting the gas downstream; and a manifold chamber disposed therebetween;

gas powered alarm means, connected to the manifold chamber via an alarm supply conduit, for producing an alarm signal when pressurised gas passes to the alarm means;

supply gas pressure sensor means, in communication with the manifold chamber, for producing an actuating flow of pressurised gas, in response to sensing of a supply gas pressure below a selected minimum pressure;

pneumatic alarm output switch means, in the alarm supply conduit and in communication with the sensor means via an actuation conduit, for controlling gas flow to the alarm means in response to the actuating flow; and alarm oscillation means for alternating the direction of the actuating flow to and from the alarm output switch means, the alarm oscillation means comprising: a vent conduit communicating between the actuation conduit and a downstream portion of the alarm supply conduit, said downstream portion being defined between the alarm means and the alarm output switch means.

2. An alarm device according to claim 1 wherein the alarm oscillation means further comprise an alarm intensity flow restrictor in the alarm supply conduit between the alarm means and the vent conduit.

3. An alarm device according to claim 1 wherein the alarm oscillation means further comprise an alarm oscillation frequency flow restrictor in the vent conduit.

4. An alarm device according to claim 1 wherein the alarm means comprise a reed alarm.

5. An alarm device according to claim 1 wherein the alarm means comprise a visual alarm indicator.

* * * * *

UNITED STATES PATENT AND TRADEMARK OFFICE

CERTIFICATE OF CORRECTION

PATENT NO. : 6,067,022

DATED : May 23, 2000

INVENTOR(S) : Ronald A. LASWICK et al.

It is certified that error appears in the above-identified patent and that said Letters Patent is hereby corrected as shown below:

On Title Page Item [54], change the title to read --LOW INPUT PRESSURE ALARM FOR GAS SUPPLY--.

Signed and Sealed this

Twenty-seventh Day of March, 2001

Nicholas P. Godici

*Attest:*

NICHOLAS P. GODICI

*Attesting Officer*

*Acting Director of the United States Patent and Trademark Office*